US010946436B2

(12) United States Patent
Seko et al.

(10) Patent No.: US 10,946,436 B2
(45) Date of Patent: Mar. 16, 2021

(54) FILLING METHOD AND FILLING DEVICE FOR KNEADED SAND

(71) Applicants: TOYOTA JIDOSHA KABUSHIKI KAISHA, Toyota (JP); SINTOKOGIO, LTD., Aichi (JP)

(72) Inventors: Masahide Seko, Anjo (JP); Masashi Morikawa, Nagakute (JP); Takumi Maegawa, Toyota (JP); Takashi Nagaya, Toyokawa (JP); Toshio Kanno, Toyokawa (JP); Hirotaka Kurita, Toyokawa (JP)

(73) Assignees: TOYOTA JIDOSHA KABUSHIKI KAISHA, Toyota (JP); SINTOKOGIO, LTD., Aichi (JP)

( * ) Notice: Subject to any disclaimer, the term of this patent is extended or adjusted under 35 U.S.C. 154(b) by 240 days.

(21) Appl. No.: 15/771,301

(22) PCT Filed: Oct. 27, 2016

(86) PCT No.: PCT/IB2016/001540
§ 371 (c)(1),
(2) Date: Apr. 26, 2018

(87) PCT Pub. No.: WO2017/077373
PCT Pub. Date: May 11, 2017

(65) Prior Publication Data

US 2018/0311723 A1 Nov. 1, 2018

(30) Foreign Application Priority Data

Nov. 6, 2015 (JP) ..... JP2015-218484

(51) Int. Cl.
*B22C 15/02* (2006.01)
*B22C 19/04* (2006.01)
*B22C 9/02* (2006.01)

(52) U.S. Cl.
CPC ..... *B22C 19/04* (2013.01); *B22C 9/02* (2013.01); *B22C 15/02* (2013.01)

(58) Field of Classification Search
CPC ..... B22C 15/02; B22C 15/08; B22C 19/04; B22C 9/02
See application file for complete search history.

(56) References Cited

U.S. PATENT DOCUMENTS 5,695,000 A * 12/1997 Uzaki ..... B22C 15/08 164/194
2015/0197044 A1 7/2015 Kato et al.
2016/0052047 A1* 2/2016 Uchida ..... B22C 15/02 164/37

FOREIGN PATENT DOCUMENTS

CN 104395012 A 3/2015
EP 2 865 460 A1 4/2015
(Continued)

OTHER PUBLICATIONS

Written Opinion of the International Searching Authority of PCT/IB2016/001540 dated Feb. 2, 2017.
(Continued)

*Primary Examiner* — Kevin E Yoon
(74) *Attorney, Agent, or Firm* — Sughrue Mion, PLLC

(57) ABSTRACT

When pressing kneaded sand in a kneading sand tank into a mold by a pressing member, a pressing force applied to a kneaded sand layer in the kneading sand tank is monitored and a moving position of the pressing member is monitored from when the pressing member starts to move. A pressing start time at which the kneaded sand starts to flow into the mold is identified based on the pressing force applied to the kneaded sand layer in the kneading sand tank, and a pressing starting position of the pressing member at the pressing start time is identified. As a result, the pressing start time and the pressing starting position of the pressing member when the
(Continued)

kneaded sand starts to flow into the mold are accurately identified, so the reliability of a filling evaluation of the kneaded sand into the mold is improved.

4 Claims, 4 Drawing Sheets

(56) References Cited

FOREIGN PATENT DOCUMENTS

| | | | | | |
|---|---|---|---|---|---|
| JP | 10-029039 | A | | 2/1998 | |
| JP | 2014-004611 | A | | 1/2014 | |
| JP | 2014-515313 | A | | 6/2014 | |
| WO | 2012/165056 | A2 | | 12/2012 | |
| WO | WO-2014156332 | A1 | * | 10/2014 | ..... B22C 15/02 |
| WO | 2015/056078 | A1 | | 4/2015 | |

OTHER PUBLICATIONS

International Search Report of PCT/IB2016/001540 dated Feb. 2, 2017.

* cited by examiner

FILLING METHOD AND FILLING DEVICE FOR KNEADED SAND

CROSS REFERENCE TO RELATED APPLICATIONS

This application is a National Stage of International Application No. PCT/IB2016/001540 filed Oct. 27, 2016, claiming priority based on Japanese Patent Application No. 2015-218484 filed Nov. 6, 2015.

BACKGROUND OF THE INVENTION

1. Field of the Invention

The invention relates to a filling method and filling device for filling kneaded sand into a mold, in order to form a core in the mold.

2. Description of Related Art

In precision molding technology for manufacturing a casting by injecting molten metal into a mold and then cooling and solidifying the molten metal, a core formed by hardened kneaded sand is widely used to provide a cavity inside a casting such as a machine part. This core is formed (molded) by pressing and filling kneaded sand into a mold from within a kneading sand tank.

With this filling method for this kneaded sand, a predetermined amount of kneaded sand is stored in the kneading sand tank, and the kneaded sand in the kneading sand tank is pressing and filled into the mold by a pressing member moving inside the kneading sand tank. At this time, the output of a cylinder device that drives the pressing member is set such that the average speed of the pressing member from the start of pressing when the kneaded sand starts to flow into the mold, until pressing is complete, approaches a pressing member speed that has been set as a target speed. With this kneaded sand filling method, the average speed of the pressing member from the start of pressing until pressing is complete is calculated by estimation, by monitoring a moving position of the pressing member and estimating a pressing start time and a pressing starting position of the pressing member when the kneaded sand starts to flow into the mold, from a waveform of the moving position of the pressing member with respect to time, which is recorded at the time of the filling, and identifying a pressing completion time at which the pressing member stops due to a limit pressure applied to the pressing member, and a pressing completion position of the pressing member at the pressing completion time. The filling of the kneaded sand into the mold is then evaluated based on this calculation result.

However, with the filling method described above, the pressing start time and the pressing starting position of the pressing member are obtained by estimation from the waveform of the moving position of the pressing member with respect to time. The actual pressing start time and the actual pressing starting position of the pressing member are unable to be identified, so the average speed of the pressing member from the start of pressing until pressing is complete are unable to be accurately calculated. Therefore, a filling evaluation obtained from this recording is unreliable. Moreover, the pressing start time and the pressing starting position of the pressing member when the kneaded sand starts to flow into the mold may change due to a change in the amount of kneaded sand in the kneading sand tank or a change in the speed of the pressing member before the pressing member contacts an upper surface of a kneaded sand layer inside the kneading sand tank. Therefore, robustness is not taken into account with this kneading method. In addition, the kneading sand tank is made of metal, so an operator is unable to visually see the pressing member contact the upper surface of the kneaded sand layer and the kneaded sand start to flow into the mold, so the aforementioned problems are unable to be solved by visual confirmation by the operator.

Moreover, with the filling method described above, a vent valve that opens and closes to allow/interrupt communication between a space inside the kneading sand tank and a space outside the kneading sand tank, is provided in the pressing member. This vent valve is controlled so as to switch from an open state to a closed state when the pressing member reaches a preset position (a position corresponding to the start of pressing). However, as described above, because the actual pressing starting position of the pressing member is unable to be identified, the difference between the position of the pressing member when the vent valve closes, which is set in advance, and the pressing starting position of the pressing member is unable to be accurately identified. Consequently, the inflow of air into the mold is unable to be accurately identified, so the filling evaluation is unreliable from this perspective as well.

Therefore, a molding apparatus for a foamed kneaded mixture is described in Japanese Patent Application Publication No. 2014-4611 (JP 2014-4611 A) as a filling apparatus for kneaded sand. The molding apparatus according to the invention described in JP 2014-4611 A includes an advance/retreat moving mechanism that makes a piston advance and retreat, an open/close driving mechanism that opens and closes a vent hole that vents air inside the cylinder, a position detection sensor that detects a position of the piston, a speed detection sensor that detects a moving speed of the piston, a pressure detection sensor that detects a pressing force applied to the foamed kneaded mixture in the cylinder, and a control portion that controls the advance/retreat moving mechanism and the open/close driving mechanism based on the detection results from the position detection sensor, the speed detection sensor, and the pressure detection sensor.

The control portion of this molding apparatus specifically performs the controls described below.

(1) The control portion determines whether the piston has reached an assumed position that is assumed as a position where the piston contacts the foamed kneaded mixture supplied into the cylinder, and controls the opening and closing of the open/close driving mechanism based on this determination.

(2) The control portion controls, based on the detection result of the speed detection sensor, the advance/retreat moving mechanism such that the moving speed detected by this speed detection sensor matches the moving speed of the piston set in advance.

(3) The control portion controls, based on the detection result of the speed detection sensor, the advance/retreat moving mechanism such that a detection value of the pressure detection sensor matches a pressure value set in advance. The control portion also controls the advance/retreat moving mechanism to stop the movement of the piston, when a pressure value detected by the pressure detection sensor is equal to or greater than a pressure value assumed when the foamed kneaded mixture is finished being pressed by the piston (i.e., in a pressing finished state).

(4) Based on the detection result of the pressure detection sensor, the control portion controls the open/close driving mechanism open when the detected pressure value is less than a pressure value assumed when the foamed kneaded mixture starts to be pressed by the piston, and controls the open/close driving mechanism closed when the detected pressure value is equal to or greater than a pressure value assumed when the foamed kneaded mixture starts to be pressed.

Also, the molding apparatus is able to perform the controls described above with the control portion by monitoring the moving speed and position of the piston, and the pressing force applied to the foamed kneaded mixture in the cylinder. As a result, the molding apparatus is able to identify conditions (i.e., the optimum moving speed, position, and pressing force of the piston) to better perform filling, and is able to fill the foamed kneaded mixture into the mold under these conditions.

SUMMARY OF THE INVENTION

As described above, the kneaded sand molding apparatus described in JP 2014-4611 A is a device that unquestionably leads to better filling by monitoring the moving speed and position of the piston, and the pressing force applied to the foamed kneaded mixture in the cylinder, and controlling these with a control portion. However, with this molding apparatus, the moving speed and position of the piston, and the pressing force applied to the foamed kneaded mixture in the cylinder are monitored, but the detection results of these are not used in a filling evaluation of the kneaded sand into the mold, and there is no such technological thought. Moreover, this molding apparatus notably includes a control portion that performs complex control, so equipment costs increase, making the molding apparatus difficult to employ.

Therefore, in a simple device that does not include a complex control portion that leads to better filling, i.e., in a filling device of a scope that is also able to cover existing filling devices, there is a need to accurately identify the pressing start time and the pressing starting position of the pressing member when the kneaded sand starts to flow into the mold, and improve the reliability of the filling evaluation when kneaded sand is filled into the mold.

The invention thus provides a filling method for kneaded sand, which accurately identifies a pressing start time and a pressing starting position of a pressing member when kneaded sand starts to flow into a mold, and consequently improve the reliability of a filling evaluation of the kneaded sand into the mold. The invention also provides a filling device for kneaded sand, which improves the reliability of the filling evaluation of the kneaded sand into the mold, while suppressing equipment costs.

A first aspect of the invention relates to a filling method for filling kneaded sand into a mold from within a kneading sand tank. This filling method includes monitoring a pressing force applied to a kneaded sand layer in the kneading sand tank and monitoring a moving position of a pressing member from when the pressing member starts to move, when pressing the kneaded sand in the kneading sand tank into the mold by a movement of the pressing member, and identifying a pressing start time when the kneaded sand starts to flow into the mold, by the pressing force applied to the kneaded sand layer in the kneading sand tank, and then identifying a pressing starting position of the pressing member at the pressing start time, and performing a filling evaluation of the kneaded sand into the mold based on the identified pressing start time and the identified pressing starting position.

A second aspect of the invention relates to a filling device that fills kneaded sand into a mold. This filling device includes a kneading sand tank within which the kneaded sand is stored; a cylinder device that has a pressing member that is able to advance and retreat inside the kneading sand tank, and presses the kneaded sand in the kneading sand tank into the mold; a position detection sensor that detects a moving position of the pressing member; a pressure detection sensor that detects a pressing force applied to a kneaded sand layer in the kneading sand tank; and an evaluation portion configured to identify, according to a detection result of the pressure detection sensor, a pressing start time at which the kneaded sand starts to flow into the mold, as well as identify, according to a detection result of the position detection sensor, a pressing starting position of the pressing member at the pressing start time, and perform a filling evaluation of the kneaded sand into the mold based on the identified pressing start time and the identified pressing starting position.

With the filling method according to the first aspect, the pressing start time and the pressing starting position of the pressing member when the kneaded sand starts to flow into the mold, which were conventionally obtained by estimating, are able to be accurately identified. The filling evaluation of the kneaded sand into the mold is performed from this information, so the reliability of the filling evaluation is able to be improved.

A filling time of the kneaded sand into the mold may be calculated from the pressing start time, and a pressing completion time at which the pressing member stops due to a limit pressure applied to the pressing member, and the filling evaluation of the kneaded sand into the mold may be performed based on the filling time. Accordingly, the filling time of the kneaded sand into the mold is able to be accurately identified, and the filling evaluation of the kneaded sand into the mold is able to be performed from the viewpoint of this filling time, so the reliability of the filling evaluation is able to be improved.

When moving the pressing member toward the kneaded sand layer in the kneading sand tank, the pressing member may be moved while venting air out from between the pressing member and an upper surface of the kneaded sand layer by opening a vent valve provided in the pressing member, and the vent valve may be closed when the pressing member reaches a preset position. An inflow of air into the mold may be calculated from a position of the pressing member when the vent valve is closed, which is preset, and the pressing starting position of the pressing member at the pressing start time, and the filling evaluation of the kneaded sand into the mold may be performed based on the inflow of air. Accordingly, the inflow of air into the mold is able to be accurately identified, and the filling evaluation of the kneaded sand into the mold is able to be performed from the viewpoint of this inflow of air, so the reliability of the filling evaluation is able to be improved.

With the filling device according to the second aspect, with a structure in which a pressure detection sensor is simply added to a conventional filling device, the pressing start time and the pressing starting position of the pressing member are able to be accurately identified. As a result, equipment costs are able to be kept down, and a highly reliable filling evaluation of the kneaded sand into the mold is able to be performed.

The evaluation portion may be configured to calculate a filling time of the kneaded sand into the mold from the pressing start time, and a pressing completion time at which the pressing member stops due to a limit pressure applied to the pressing member, and perform the filling evaluation of the kneaded sand into the mold based on the filling time.

Accordingly, the evaluation portion is able to perform a highly reliably filling evaluation of the kneaded sand into the mold, from the viewpoint of the filling time of the kneaded sand into the mold. Moreover, the evaluation portion merely includes a simple calculation circuit, so equipment costs are able to be kept to a minimum.

The filling device may further include a vent valve that is provided in the pressing member and opens and closes to allow/interrupt communication between a space inside the kneading sand tank and a space outside the kneading sand tank; and a control portion configured to switch the vent valve from an open state to a closed state when the position detection sensor detects that the pressing member has reached a preset position when the pressing member moves toward the kneaded sand layer in the kneading sand tank. The evaluation portion may be configured to calculate an inflow of air into the mold from a position of the pressing member when the vent valve closes, which is preset, and the pressing starting position of the pressing member at the pressing start time, and perform the filling evaluation of the kneaded sand into the mold based on the inflow of air. Accordingly, substantially the same constituent members as those of a conventional filling device are provided, so equipment costs are able to be kept down, and the evaluation portion is able to perform a highly reliably filling evaluation of the kneaded sand into the mold, from the viewpoint of the inflow of air into the mold.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
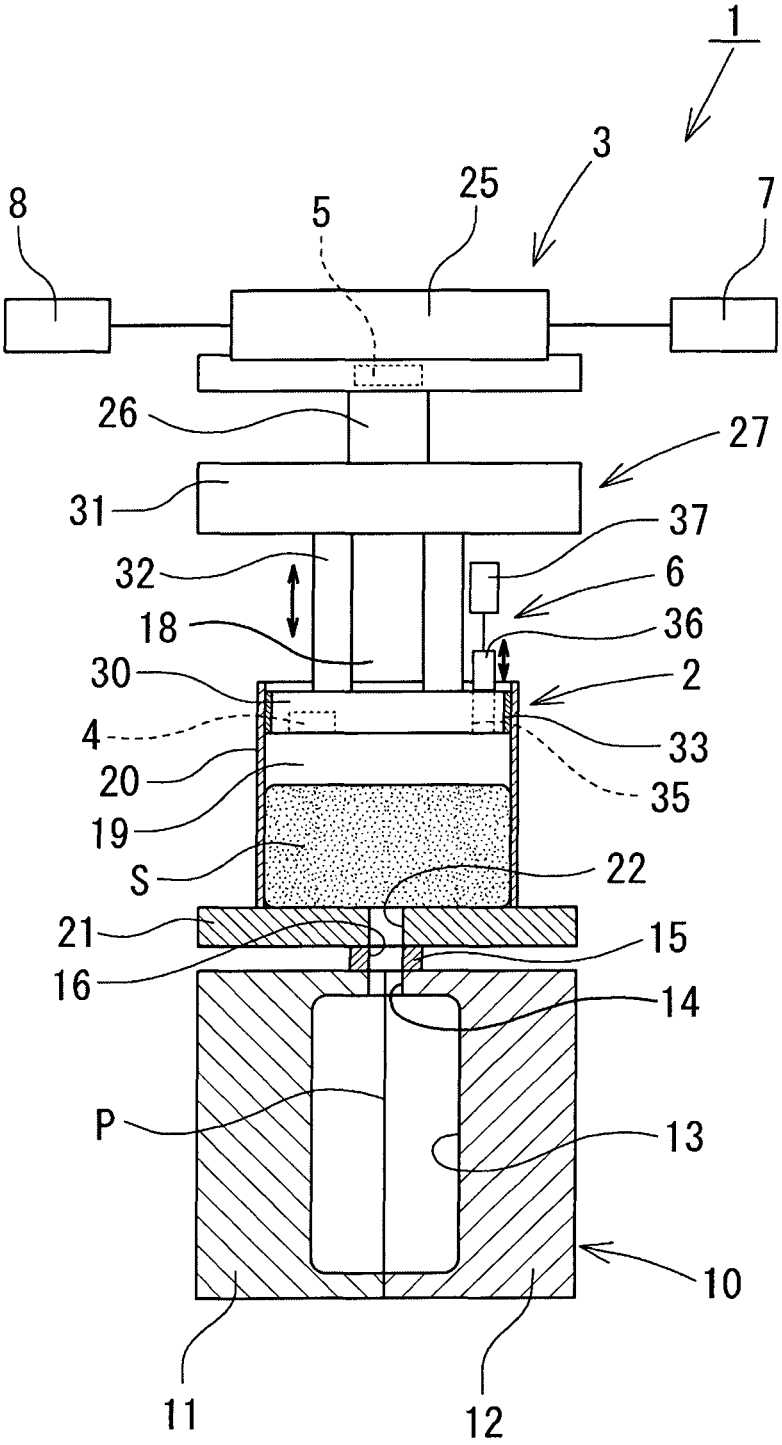
FIG. 1 is a schematic of a filling device according to one example embodiment of the invention.

Hereinafter, example embodiments of the invention will be described in detail with reference to FIGS. 1 to 3. A filling device 1 according to one example embodiment of the invention includes a kneading sand tank 2 within which kneaded sand S is stored, a cylinder device 3 that has a pressing member 27 that is able to advance and retreat inside the kneading sand tank 2 and presses the kneaded sand S that is in the kneading sand tank 2 into a mold 10, a pressure detection sensor 4 that detects a pressing force applied to the kneaded sand S that is in the kneading sand tank 2, a position detection sensor 5 that is formed by an encoder or the like, for example, and detects a moving position of the pressing member 27, a vent valve 6 that is provided in a small diameter plate-shaped portion 30 of the pressing member 27, and opens and closes to allow or interrupt communication between a space outside the kneading sand tank 2 and a space inside the kneading sand tank 2, i.e., between an upper space 18 and a lower space 19 in the small diameter plate-shaped portion 30, a control portion 7 that both controls the driving of the cylinder device 3 and controls the vent valve 6 open and closed, in response to a detection signal from the position detection sensor 5, and an evaluation portion 8 that performs a filling evaluation of the kneaded sand S into the mold 10 based on the detection results of the position detection sensor 5 and the pressure detection sensor 4, as shown in FIG. 1.

The mold 10 includes a fixed mold 11 and a movable mold 12 that are divided by a parting line P. When the fixed mold 11 and the movable mold 12 are closed, a cavity 13 is formed inside the two. A receiving hole 14 for the kneaded sand S that communicates with the cavity 13 is formed in an upper portion of the mold 10. The filling device 1 is able to be mounted above this mold 10.

The kneading sand tank 2 is formed in an open cylindrical shape with a bottom, and includes a tank main body 20 and a bottom wall portion 21. The tank main body 20 has an opening that is generally circular when viewed from above, passing through it in the axial direction. The bottom wall portion 21 is plate shaped and closes off a lower end opening of the tank main body 20. A filler hole 22 is provided in the bottom wall portion 21. A plate-shaped thermal insulator 15 is attached to a lower surface of the bottom wall portion 21. The thermal insulator 15 is formed having a cross-sectional area that is much smaller than that of the bottom wall portion 21. A communication hole 16 that communicates with the filler hole 22 of the bottom wall portion 21, is formed in the thermal insulator 15. A predetermined amount of the kneaded sand S is stored in this kneading sand tank 2. The kneaded sand S is a mixture of artificial sand, and a water-soluble inorganic binder that includes liquid glass (sodium silicate), water, and a surfactant, which have been kneaded to a foamed state, and has a suitable viscosity. In this example embodiment, the kneaded sand S in which the constituent elements described above are mixed and kneaded to a foamed state, is formed in the kneading sand tank 2.

The cylinder device 3 includes a cylinder main body 25 to which compressed air is supplied from an air supply, a piston rod 26 that expands and contracts from the cylinder main body 25, and the pressing member 27 that is integrally connected to a tip end of the piston rod 26. The air supply of the cylinder device 3 is electrically connected to the control portion 7. The position detection sensor 5 that detects a stroke amount (a moving amount) of the piston rod 26, and thus detects a moving position of the pressing member 27, is provided on the cylinder device 3. The position detection sensor 5 is electrically connected to both the control portion 7 and the evaluation portion 8. The pressing member 27 includes the small diameter plate-shaped portion 30 that is able to advance and retreat inside the kneading sand tank 2 and slides inside the kneading sand tank 2, a large diameter plate-shaped portion 31 that has a larger diameter than the small diameter plate-shaped portion 30 and has a larger diameter than an outside diameter of the kneading sand tank 2, and a plurality of connecting shaft portions 32 that connect the small diameter plate-shaped portion 30 and the large diameter plate-shaped portion 31 together. The large diameter plate-shaped portion 31 is positioned above the small diameter plate-shaped portion 30. The small diameter plate-shaped portion 30 and the large diameter plate-shaped portion 31 are arranged concentrically. The large diameter plate-shaped portion 31 is integrally connected to the tip end of the piston rod 26. A ring-shaped packing 33 is installed on an outer peripheral surface of the small diameter plate-shaped portion 30. The pressure detection sensor 4 that detects the pressing force applied to the kneaded sand S inside the kneading sand tank 2 is built into the small diameter plate-shaped portion 30. More specifically, the pressure detection sensor 4 is built into the small diameter plate-shaped portion 30 such that a sensor surface of the pressure detection sensor 4 is exposed inside the kneading sand tank 2, and contacts the kneaded sand S. Also, the pressure detection sensor 4 detects the pressing force applied to the kneaded sand S by the pressing member 27, by detecting the pressing force from the kneaded sand S that contacts the sensor surface of the pressure detection sensor 4. The pressure detection sensor 4 is electrically connected to the evaluation portion 8.

The vent valve 6 is arranged in the small diameter plate-shaped portion 30 of the pressing member 27. The vent valve 6 includes a venting piston portion 36 that is slidably arranged inside a vent hole 35 that passes through the small diameter plate-shaped portion 30 in the axial direction thereof, and a driving mechanism 37 that drives the venting piston portion 36 into/out of the vent hole 35. Also, when the vent valve 6 is controlled open, the venting piston portion 36 moves out of the vent hole 35 by the driving of the driving mechanism 37, such that the vent hole 35 is opened. As a result, the upper space 18 of the small diameter plate-shaped portion 30 (i.e., the space outside the kneading sand tank 2) is communicated with the lower space 19 of the small diameter plate-shaped portion 30 (the space inside the kneading sand tank 2). On the other hand, when the vent valve 6 is controlled closed, the venting piston portion 36 is snugly inserted into the vent hole 35 by the driving of the driving mechanism 37, such that the vent hole 35 is closed. As a result, communication between the upper space 18 and the lower space 19 of the small diameter plate-shaped portion 30 is interrupted. The driving mechanism 37 of the vent valve 6 is electrically connected to the control portion 7.

Figure 2A:
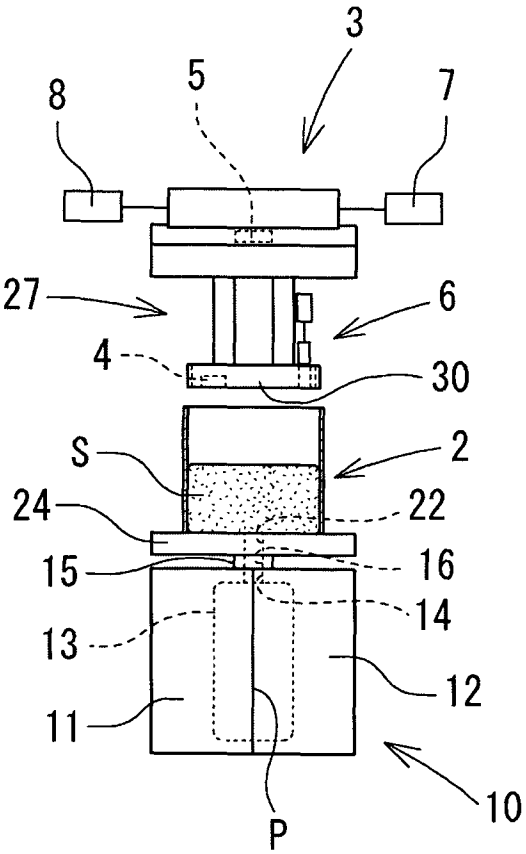
FIG. 2A is a view showing a frame format of kneaded sand being filled into a cavity of a mold from a kneading sand tank by the filling device according to the example embodiment of the invention.
Figure 2B:
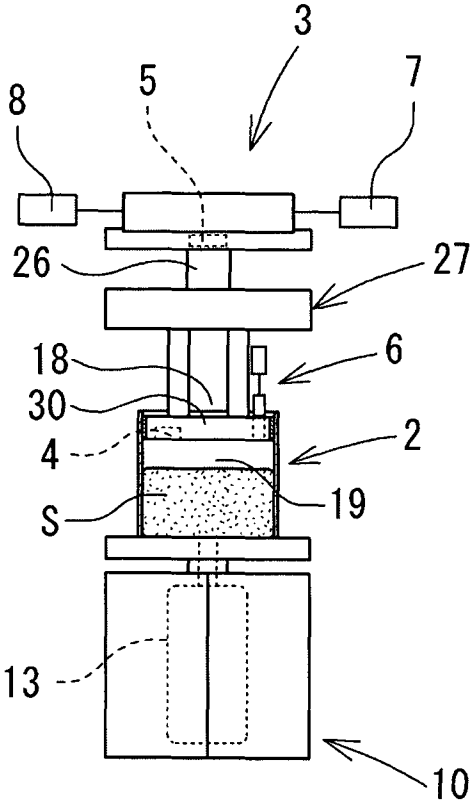
FIG. 2B is view showing another frame format of the kneaded sand being filled into the cavity of the mold from the kneading sand tank by the filling device according to the example embodiment of the invention.

Next, a filling method for filling the kneaded sand S that is in the kneading sand tank 2 into the cavity 13 in the mold 10 using the filling device 1 according to this example embodiment of the invention will be described with reference FIGS. 2A to 2E, as well as FIG. 3. First, the artificial sand and the water-soluble inorganic binder that includes liquid glass, water, and a surfactant are mixed and kneaded inside the kneading sand tank 2 to form a predetermined amount of foamed kneaded sand S. When this kneading is performed, the communication hole 16 in the thermal insulator 15 is closed by a plug, not shown. The amount of kneaded sand S stored in the kneading sand tank 2 is larger than the predetermined amount that is pressed into the cavity 13 of the mold 10. Then, as shown in FIG. 2A, the plug is removed, and the kneading sand tank 2 is set on the mold 10 such that the communication hole 16 in the thermal insulator 15 is communicated with the receiving hole 14 in the mold 10. At this time, because the kneaded sand S is viscous, the kneaded sand S in the kneading sand tank 2 does not leak out through the communication hole 16 in the thermal insulator 15. Then, the cylinder device 3 is set above the kneading sand tank 2. At this time, the vent valve 6 is in the open state.

Next, the cylinder device 3 is driven in response to a signal from the control portion 7, such that the piston rod 26 is moved in a direction extending from the cylinder main body 25, whereupon the small diameter plate-shaped portion 30 of the pressing member 27 advances into the kneading sand tank 2, and moves toward the kneaded sand S in the kneading sand tank 2 while sliding inside the kneading sand tank 2. At this time, air between the small diameter plate-shaped portion 30 of the pressing member 27 and an upper surface of the kneaded sand layer S (i.e., air in the lower space 19) is vented through the vent valve 6. Also, from the time at which the pressing member 27 starts to move, the moving position of the pressing member 27 is constantly detected by the position detection sensor 5, and the detection result is transmitted to both the control portion 7 and the evaluation portion 8. Further, from the time at which the pressing member 27 starts to move, the pressing force applied to the kneaded sand layer S in the kneading sand tank 2 is constantly detected by the pressure detection sensor 4, and the detection result is transmitted to the evaluation portion 8.

Figure 3:
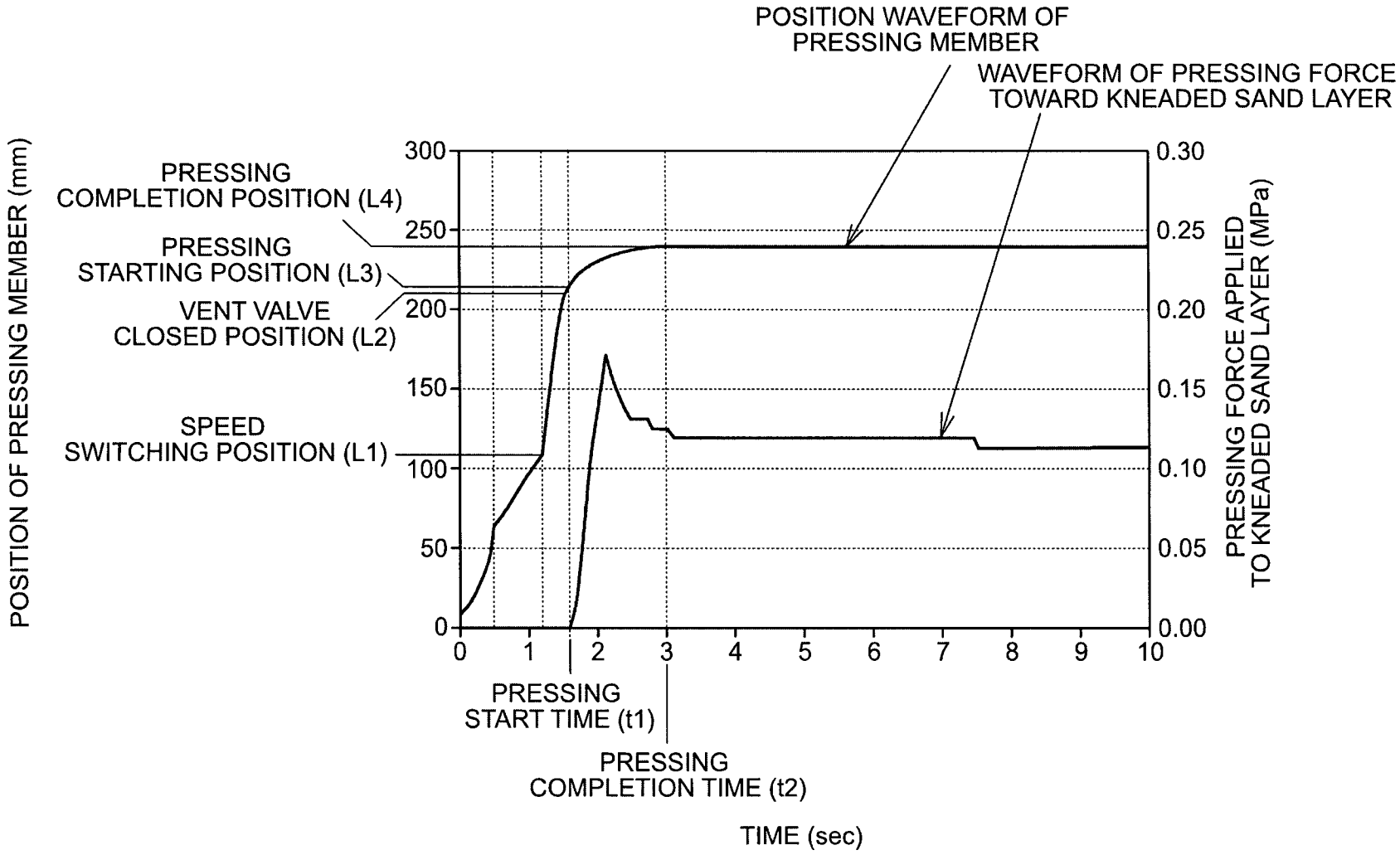
FIG. 3 is a graph illustrating detection content transmitted to an evaluation portion from a position detection sensor and a pressure detection sensor of the filling device according to the example embodiment of the invention.

Also, referring to FIG. 3 as well, when the position detection sensor 5 detects that the small diameter plate-shaped portion 30 of the pressing member 27 has reached a speed switching position L1 (the position shown in FIG. 2B) set in advance, a detection signal is transmitted to the cylinder device 3 via the control portion 7, and the speed of the piston rod 26 of the cylinder device 3 is switched to high speed and the pressing member 27 continues to move. The output of the cylinder device 3 at this time is set such that an average speed of the pressing member 27 from the start of pressing when the kneaded sand S starts to flow into the mold 10 until pressing is complete, approaches a speed set in advance as a target speed.

Figure 2C:
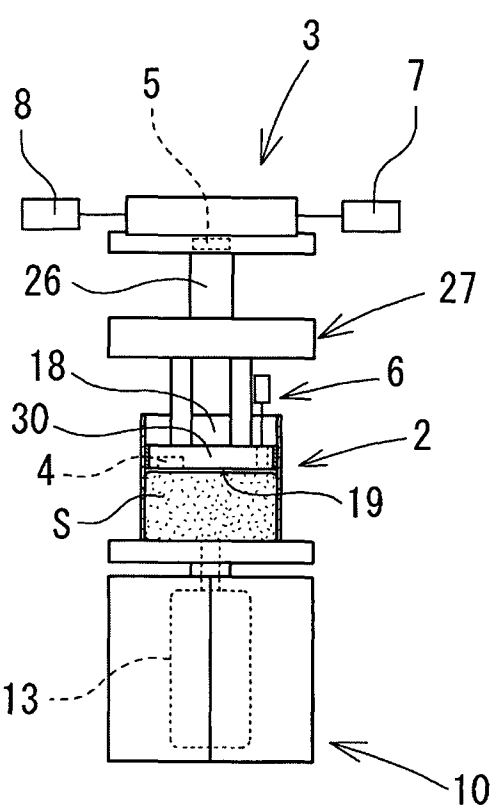
FIG. 2C is view showing yet another frame format of the kneaded sand being filled into the cavity of the mold from the kneading sand tank by the filling device according to the example embodiment of the invention.

Then, referring to FIG. 3 as well, the pressing member 27 continues to move, and when the position detection sensor 5 detects that the small diameter plate-shaped portion 30 of the pressing member 27 has approached the upper surface of the kneaded sand layer S and reached a vent valve closed position L2 set in advance, as shown in FIG. 2C, a detection signal is transmitted to the driving mechanism 37 of the vent valve 6 via the control portion 7. As a result, the vent valve 6 closes, thereby cutting off communication between the upper space 18 and the lower space 19 of the small diameter plate-shaped portion 30. Then, as shown in FIG. 2D, the small diameter plate-shaped portion 30 of the pressing member 27 contacts the upper surface of the kneaded sand layer S, and the kneaded sand S in the kneading sand tank 2 is pressed into the cavity 13 of the mold 10 through the filler hole 22 in the bottom wall portion 21, the communication hole 16 in the thermal insulator 15, and the receiving hole 14 in the mold 10, by the pressing force of the pressing member 27. When the kneaded sand S is being pressed in, reaction force from the kneaded sand layer S in the kneading sand tank 2, and sliding resistance between a packing 33 provided on an outer periphery of the small diameter plate-shaped portion 30 and an inside wall surface of the kneading sand tank 2 (the tank main body 20), are applied to the pressing member 27. After the vent valve 6 has been placed in a closed state, the small diameter plate-shaped portion 30 of the pressing member 27 contacts the upper surface of the kneaded sand layer S, and the kneaded sand S starts to be pressed into the cavity 13 of the mold 10 from inside the kneading sand tank 2, so air between the small diameter plate-shaped portion 30 that has reached a vent valve closed position L2 and the upper surface of the kneaded sand layer S (i.e., air in the lower space 19) flows, together with the kneaded sand S, into the cavity 13 of the mold 10.

Figure 2E:
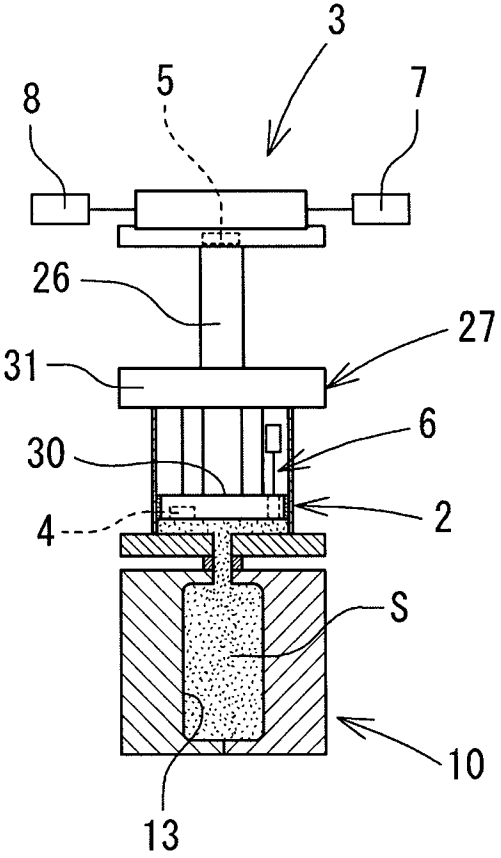
FIG. 2E is view showing another frame format of the kneaded sand being filled into the cavity of the mold from the kneading sand tank by the filling device according to the example embodiment of the invention.
Figure 2D:
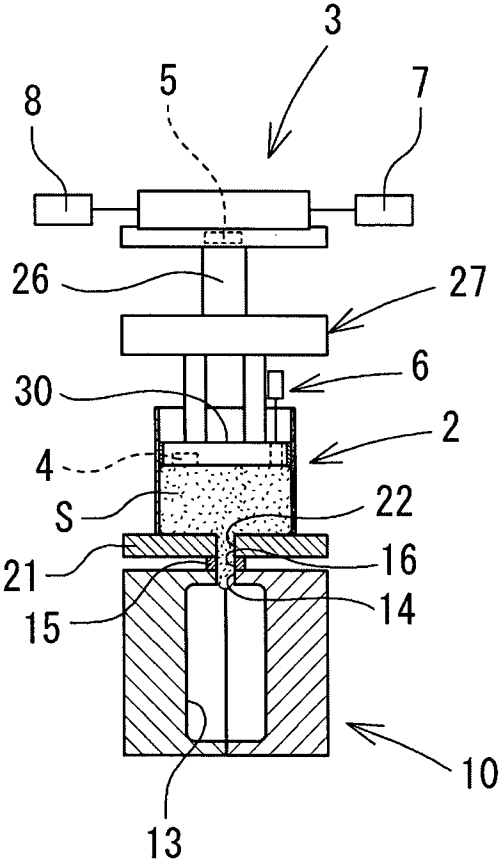
FIG. 2D is view showing still another frame format of the kneaded sand being filled into the cavity of the mold from the kneading sand tank by the filling device according to the example embodiment of the invention.

Then, as shown in FIG. 2E, the pressing member 27 stops when a limit pressure is applied to the pressing member 27. This limit pressure is the pressure at which the maximum output from the cylinder device 3 matches the reaction force from the kneaded sand layer S in the kneading sand tank 2, and the sliding resistance between the packing 33 provided on the outer periphery of the small diameter plate-shaped portion 30 and the inside wall surface of the kneading sand tank 2 (i.e., the tank main body 20), which are applied to the pressing member 27. Then, when the position detection sensor 5 detects that the pressing member 27 has stopped for a predetermined period of time, a detection signal is transmitted to the cylinder device 3 via the control portion 7, and the driving of the cylinder device 3 is stopped. This point in time is a pressing completion time t2 when the kneaded sand S is finished being pressed into the mold 10 from the kneading sand tank 2. The structure may also be such that the driving of the cylinder device 3 is stopped and the pressing member 27 is stopped, when the cylinder device 3 detects that the limit pressure has been applied to the pressing member 27 for a predetermined period of time, instead of based on the detection result from the position detection sensor 5. When pressing is complete, the large diameter plate-shaped portion 31 of the pressing member 27 is stopped at a position close to the upper end of the kneading sand tank 2.

Then, the evaluation portion 8 obtains the detection results from the position detection sensor 5 and the pressure detection sensor 4, i.e., the graph shown in FIG. 3. In this evaluation portion 8, based on the graph shown in FIG. 3, first, the time when the pressure detection sensor 4 detects the pressing force applied to the kneaded sand layer S in the kneading sand tank 2, i.e., the point at which the pressing force toward the kneaded sand layer S starts to be a rise in the waveform of this pressing force in FIG. 3, is identified as the pressing start time t1 when the kneaded sand S starts to flow into the mold 10, and the pressing starting position L3 of the pressing member 27 at this pressing start time t1 is identified by the detection result of the position detection sensor 5 (i.e., the position waveform of the pressing member 27). Also, the time when the stopping of the pressing member 27 is detected by the position detection sensor 5 is identified as the pressing completion time t2, and the pressing completion position L4 of the pressing member 27 at this pressing completion time t2 is identified. From this information, the filling time from the start of pressing until pressing is complete (i.e., pressing completion time t2−pressing start time t1) is calculated, and the average speed of the pressing member 27 from the start of pressing until pressing is complete (i.e., (pressing completion position L4−pressing starting position L3)/filling time) is calculated. Also, the inflow of air into the mold 10 is calculated from the vent valve closed position L2 of the pressing member 27 when the vent valve 6 is closed, which is set in advance, and the pressing starting position L3 of the pressing member 27 at the pressing start time t1 (i.e., (pressing starting position L3−vent valve closed position L2)×cross-sectional area in the tank main body 20).

Finally, the evaluation portion 8 performs a filling evaluation of the kneaded sand S into the mold 10 based on the filling time from the start of pressing until pressing is complete, and the inflow of air into the mold 10. This filling evaluation is also linked to an evaluation of the molded product itself that is formed inside the mold 10.

Regarding the method of this filling evaluation, an upper limit value of the filling time is set, for example, and with this upper limit value as a threshold value, a determination of "Good" is made when the filling time does not exceed the upper limit value, while a determination of "Poor" is made when the filling time exceeds the upper limit value. Meanwhile, an upper limit value for the inflow of air is also set, for example, and with this upper limit value as a threshold value, a determination of "Good" is made when the inflow of air does not exceed the upper limit value, and a determination of "Poor" is made when the inflow of air exceeds the upper limit value.

The evaluation portion 8 may also calculate the average speed of the pressing member 27 from the start of pressing until pressing is complete, and perform the filling evaluation of the kneaded sand S into the mold 10 by comparing this average speed with a preset target speed. However, in this example embodiment, the filling time from the start of pressing until pressing is complete and the flowrate of air into the mold 10 are used in the filling evaluation of the kneaded sand S into the mold 10, so an evaluation that is unquestionably more in line with reality than the filling evaluation based on the average speed of the pressing member 27 that is conventionally employed is able to be performed. Therefore, the evaluation content in which the average speed of the pressing member 27 is compared to the preset target speed is kept in mind as reference.

When referencing the waveform of the pressing force applied to the kneaded sand layer S in the kneading sand tank 2, which is detected by the pressure detection sensor 4, in FIG. 3, the pressing force rises suddenly from the pressing start time t1 and reaches peak pressure after a predetermined period of time has passed, and then the pressing force gradually falls until the time pressing completion time t2. It is presumed that this initial waveform is not indicative of a shift in the pressing force applied to the entire kneaded sand layer S in the kneading sand tank 2. That is, with the initial waveform, the behavior of the kneaded sand layer S in the kneading sand tank 2 is unstable and has not yet reached a static pressure state, so it is presumed that localized pressure is temporarily detected by the pressure detection sensor 4 and this is the pressure that has reached the peak pressure. Then, past the peak pressure, as the pressing nears completion, the behavior of the kneaded sand layer S in the kneading sand tank 2 stabilizes and approaches a static pressure state, so it is thought that the pressure detection sensor 4 will detect the pressing force applied to the entire kneaded sand layer S in the kneading sand tank 2. However, it is able to be determined that the starting point of the rise in the waveform of the pressing force toward the kneaded sand layer S in FIG. 3 is indeed the point at which the pressing force from the pressing member 27 starts to be applied to the kneaded sand layer S in the kneading sand tank 2.

In the example embodiment of the invention described above, when pressing the kneaded sand S in the kneading sand tank 2 into the mold 10 by the movement of the pressing member 27, the pressing force applied to the kneaded sand layer S in the kneading sand tank 2 is monitored by the pressure detection sensor 4 and the moving position of the pressing member 27 is monitored by the position detection sensor 5, from the time the pressing member 27 starts to move. The pressing start time t1 when the kneaded sand S starts to flow into the mold 10 is able to be identified based on the detection result of the pressure detection sensor 4, and the pressing starting position L3 of the pressing member 27 at this pressing start time t1 is able to be identified by the position detection sensor 5. As a result, the pressing start time t1 and the pressing starting position L3 of the pressing member 27 when the kneaded sand S starts to flow into the mold 10, which were conventionally obtained by estimating, are able to be accurately identified. Consequently, the filling time from the start of pressing until pressing is complete, and the inflow of air into the mold 10 at the time of filling, are able to be accurately calculated, so the reliability of the filling evaluation of the kneaded sand S into the mold 10 is able to be improved.

With the filling device 1 for kneaded sand according the example embodiment of the invention, the foamed kneaded sand S is formed by mixing and kneading artificial sand, and a water-soluble inorganic binder that includes liquid glass, water, and a surfactant, in the kneading sand tank 2. Therefore, by providing the pressure detection sensor 4 on the small diameter plate-shaped portion 30 of the pressing member 27, damage to the pressure detection sensor 4 is able to be inhibited. That is, when the pressure detection sensor 4 is mounted on the kneading sand tank 2 side, there is a possibility that the pressure detection sensor 4 may become damaged during mixing and kneading of the constituent members described above in the kneading sand tank 2, but this problem is able to be eliminated by providing the pressure detection sensor 4 on the small diameter plate-shaped portion 30 of the pressing member 27.

What is claimed is:

1. A filling method for filling kneaded sand into a mold from within a kneading sand tank, comprising:

monitoring a pressing force applied to a kneaded sand layer in the kneading sand tank and monitoring a moving position of a pressing member from when the pressing member starts to move, when pressing the kneaded sand in the kneading sand tank into the mold by a movement of the pressing member, the pressing member being part of a cylinder device, and the pressing member advances and retreats inside the kneading sand tank, and presses the kneaded sand in the kneading sand tank into the mold;

identifying a pressing start time when the kneaded sand starts to flow into the mold, by the pressing force applied to the kneaded sand layer in the kneading sand tank, and then identifying a pressing starting position of the pressing member at the pressing start time, and performing a filling evaluation of the kneaded sand into the mold based on the identified pressing start time and the identified pressing starting position; and opening and closing a vent valve provided in the pressing member to allow/interrupt communication between a space inside the kneading sand tank and a space outside the kneading sand tank;

wherein when moving the pressing member toward the kneaded sand layer in the kneading sand tank, the pressing member is moved while venting air out from between the pressing member and an upper surface of the kneaded sand layer by opening the vent valve, and the vent valve is closed when the pressing member reaches a preset position; and an inflow of air into the mold is calculated from a position of the pressing member when the vent valve is closed, which is preset, and the pressing starting position of the pressing member at the pressing start time, and the filling evaluation of the kneaded sand into the mold is performed based on the inflow of air.

2. The filling method according to claim 1, wherein a filling time of the kneaded sand into the mold is calculated from the pressing start time, and a pressing completion time at which the pressing member stops due to a limit pressure applied to the pressing member, and the filling evaluation of the kneaded sand into the mold is performed based on the filling time.

3. A filling device that fills kneaded sand into a mold, comprising:

a kneading sand tank within which the kneaded sand is stored;

a cylinder device that has a pressing member that is able to advance and retreat inside the kneading sand tank, and presses the kneaded sand in the kneading sand tank into the mold;

a position detection sensor that detects a moving position of the pressing member;

a pressure detection sensor that detects a pressing force applied to a kneaded sand layer in the kneading sand tank; and calculator configured to identify, according to a detection result of the pressure detection sensor, a pressing start time at which the kneaded sand starts to flow into the mold, as well as identify, according to a detection result of the position detection sensor, a pressing starting position of the pressing member at the pressing start time, and perform a filling evaluation of the kneaded sand into the mold based on the identified pressing start time and the identified pressing starting position;

a vent valve that is provided in the pressing member and opens and closes to allow/interrupt communication between a space inside the kneading sand tank and a space outside the kneading sand tank, wherein the vent valve closes when the position detection sensor detects that the pressing member has reached a preset position when the pressing member moves toward the kneaded sand layer in the kneading sand tank, wherein the calculator is configured to calculate an inflow of air into the mold from a position of the pressing member when the vent valve closes, which is preset, and the pressing starting position of the pressing member at the pressing start time, and perform the filling evaluation of the kneaded sand into the mold based on the inflow of air, wherein the pressing member includes a small diameter plate-shaped portion, and a large diameter plate-shaped portion connected to the small diameter plate-shaped portion by a plurality of connecting shaft portions.

4. The filling device according to claim 3, wherein:

the calculator is configured to calculate a filling time of the kneaded sand into the mold from the pressing start time, and a pressing completion time at which the pressing member stops due to a limit pressure applied to the pressing member, and perform the filling evaluation of the kneaded sand into the mold based on the filling time.

* * * * *